United States Patent [19]

Daugherty

[11] Patent Number: 4,592,266

[45] Date of Patent: Jun. 3, 1986

[54] GUITAR STRAP HOOK

[75] Inventor: Robert W. Daugherty, Dayton, Ohio

[73] Assignee: Dayton Band, Inc., Dayton, Ohio

[21] Appl. No.: 650,039

[22] Filed: Sep. 13, 1984

[51] Int. Cl.[4] ..... G10G 5/00

[52] U.S. Cl. ..... 84/327; 224/910

[58] Field of Search ..... 84/327; 224/910

[56] References Cited

U.S. PATENT DOCUMENTS

| | | | |
|---|---|---|---|
| 3,323,698 | 6/1967 | Sottile | 224/5 |
| 3,894,464 | 7/1975 | Brooks | 84/327 |
| 4,014,240 | 3/1977 | Pullen | 84/327 |
| 4,188,851 | 2/1980 | Wolf | 84/327 |
| 4,291,822 | 9/1981 | Simonds | 84/327 X |

*Primary Examiner*—Lawrence R. Franklin

*Attorney, Agent, or Firm*—Biebel, French & Nauman

[57] ABSTRACT

A guitar strap hook particularly adapted for attachment of straps to wooden guitars. The hook mounts on the side of the guitar against the heel portion of the neck. A screw is angled through the base of the hook and the side of the guitar and then into the foot portion of the neck.

3 Claims, 7 Drawing Figures

GUITAR STRAP HOOK

BACKGROUND OF THE INVENTION

This invention relates to strap attachment means for a guitar. It is common practice to attach a guitar strap to a guitar on the side thereof in the area overlying the tail block. A second attachment is made at the opposite end of the guitar on or near the neck. For a guitar having a fiberglass body the strap may be attached to a button or similar device secured directly to the side of the guitar in the region near the neck. However, this means of attachment has not been satisfactory for wooden guitars, because the wood side panels are not strong enough to withstand the localized forces generated at the point of button insertion. Consequently a strap for a wooden guitar is oftentimes attached to the neck itself in the region near the side panel. This creates another problem because the button or other strap attachment device interferes with the movement of the player's hand along the heel portion of the neck.

SUMMARY OF THE INVENTION

This invention provides a hook for attachment of support straps to wooden guitars and the like. The hook is positioned on the side of the guitar against the heel portion of the neck and has a laterally displaced projection for attachably receiving the guitar strap. The hook is attached to the foot portion of the neck by a screw which angles downwardly through the side panel of the guitar.

The hook preferably comprises a flat base portion and an upwardly curled strap receiving portion. The base portion may be provided with a screw receiving aperture angled downwardly at an angle of about 15° from the vertical.

Accordingly, it is an object of this invention to provide improved strap attachment means for a guitar.

It is another object of this invention to provide an improved guitar strap hook.

Other objects and advantages of the invention will be apparent from the following description, the accompanying drawings and the appended claims.

DESCRIPTION OF THE PREFERRED EMBODIMENT

Figure 1:
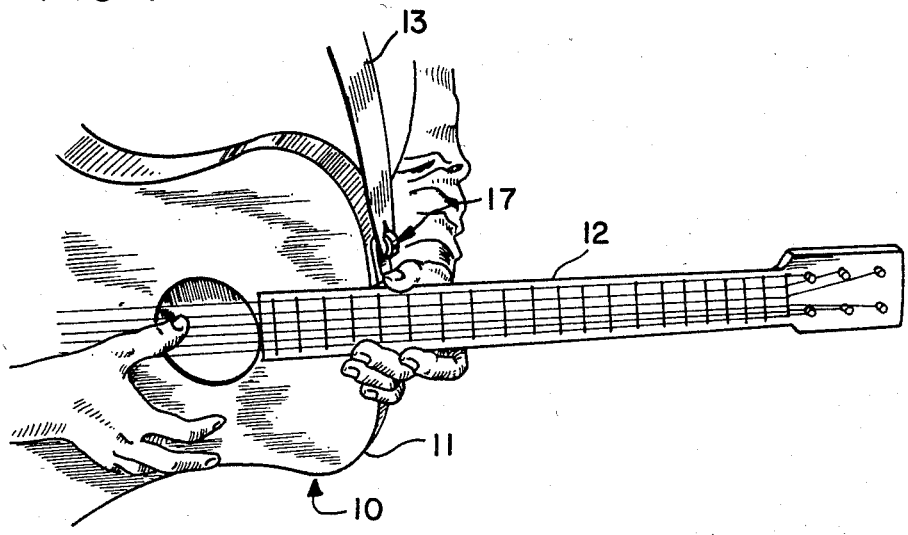
FIG. 1 is a pictorial illustration of a strap attached to a guitar as viewed from the front.

A guitar 10 may be supported in accordance with this invention, as generally illustrated in FIG. 1. Thus guitar

10 may comprise a body 11, a neck 12 and a strap 13. Strap 13 is attached to a hook 17 as illustrated in greater detail in FIGS. 2 through 7. As illustrated in FIG. 1, hook 17 is configured in such a manner as to provide non-obstructed movement of the hand of the player along the neck of the guitar.

Figure 2:
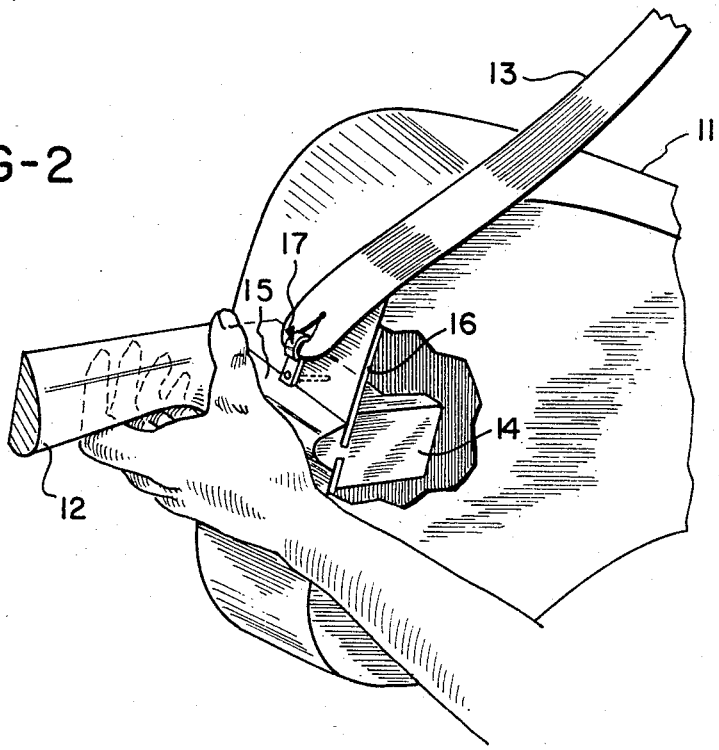
FIG. 2 is a partially cut-away rear view of a strap attached to a guitar.
Figure 3:
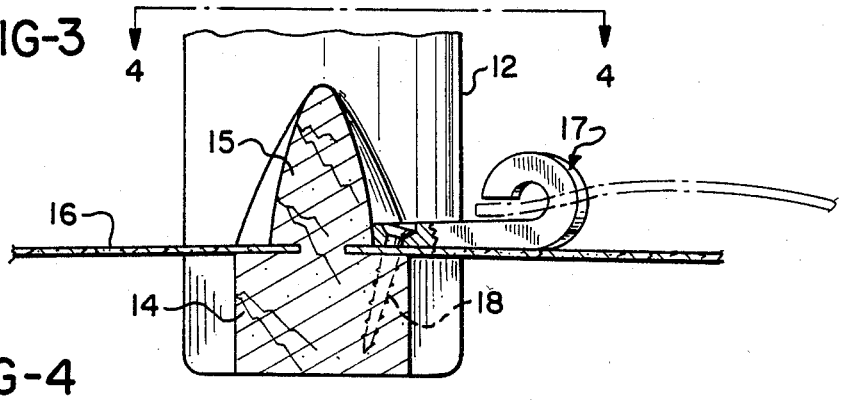
FIG. 3 is a cross-sectional drawing taken through the side of a guitar to illustrate the fastening of a hook to the foot of the guitar neck.
Figure 4:
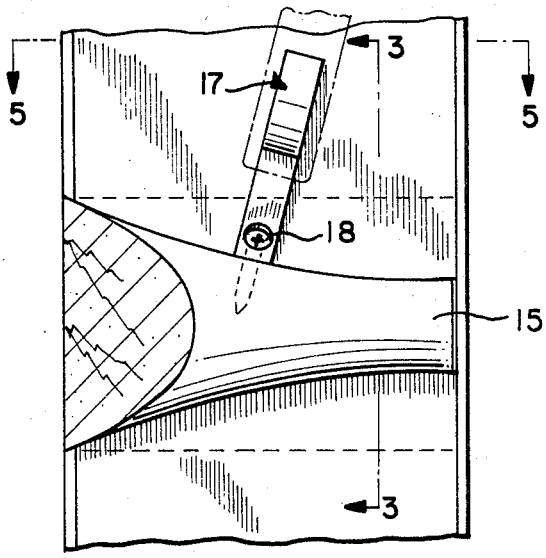
FIG. 4 is a view taken along lines 4—4 of FIG. 3.
Figure 5:
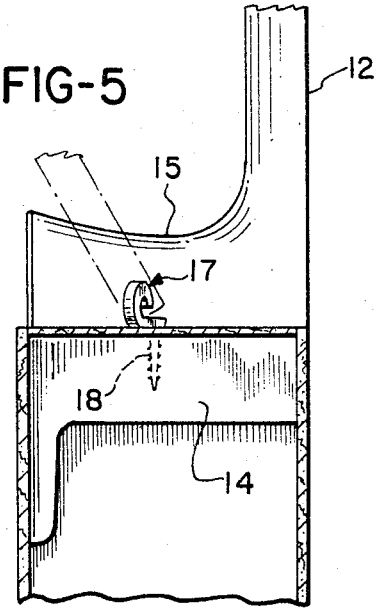
FIG. 5 is a cross-sectional drawing taken along lines 5—5 of FIG. 4.

Neck 12 of guitar 10 is customarily attached to body 11 as best illustrated in FIG. 2. Thus the neck 12 is provided with a heel portion 15 and a foot portion 14 which are dove tailed into the side panel 16 of guitar body 11. The neck is glued into place with side panel 16 captured between heel 15 and foot 14. Hook 17 is secured to foot 14 as best illustrated in FIGS. 3 through 5. Attachment is made in the central region of side panel 16 in order to provide balanced suspension for the guitar.

Figure 6:
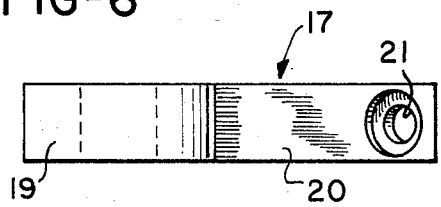
FIG. 6 is a top plan view of a guitar strap hook.
Figure 7:
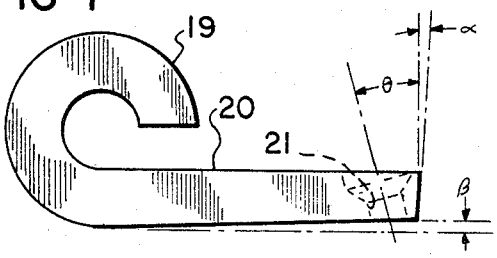
FIG. 7 is a side elevation view of a guitar strap hook.

Hook 17 may be configured as generally illustrated in FIGS. 6 and 7. Thus hook 17 may comprise a flat base portion 20 for placement on the side panel 16 against heel 15 and an upwardly curled portion 19 for receiving strap 13. Base 20 is provided with a screw receiving aperture 21 angled downwardly from the vertical, as illustrated by the angle $\theta$. In preferred embodiment the angle $\theta$ is an angle of about 15°. The leading portion of the base 20 may be chamfered (as illustrated by the angle $\alpha$) for conformable placement against heel 15. The bottom of base 20 may also be champfered (illustrated by the angle $\beta$) for conformance against side panel 16.

Hook 17 is attached to foot 14 by a screw 18 which is fitted through the aperture 21 and screwed angularly through side panel 16. This anchors the hook firmly and avoids any stress on the side panel. Prior to fastening, hook 17 is positioned on side panel 16 flush against heel 15, as best illustrated in FIGS. 3 and 4. This causes a slight angling of the hook relative to the plane of FIG. 3. Such angling accommodates attachment of strap 13.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a guitar comprising a body having a side panel extending between the heel and the foot of a neck mounted thereon, improved strap attachment means comprising:

hook means positioned centrally on said side panel against said heel and provided with a laterally displaced projection for attachably receiving a guitar strap, and an attachment screw angling downwardly through said hook means and into said foot.

2. Improved strap attachment means according to claim 1 wherein said projection comprises an upwardly curled hook.

3. The improvement of claim 2 wherein said screw is angled downwardly at an angle of about 15 degrees from the vertical.

* * * * *